US005937522A

United States Patent [19]

Althaus et al.

[11] Patent Number: 5,937,522

[45] Date of Patent: Aug. 17, 1999

[54] BLADE REPLACEMENT DEVICE WITH USED BLADE STORAGE

[75] Inventors: Wolfgang Rainer Althaus, Wuppertal, Germany; Fritz Peter Horky, Derby, Conn.

[73] Assignee: Warner-Lambert Company, Morris Plains, N.J.

[21] Appl. No.: 08/841,881

[22] Filed: May 5, 1997

[51] Int. Cl.[6] ..... B26B 21/24; A45C 11/26; B65D 83/10

[52] U.S. Cl. ..... 30/40.2; 206/354; 206/359; 206/360

[58] Field of Search ..... 206/352, 354, 206/359, 360, 370; 30/32, 38, 40, 40.1, 40.2, 62, 75, 541

[56] References Cited

U.S. PATENT DOCUMENTS

| | | | |
|---|---|---|---|
| 2,622,322 | 12/1952 | Mix | 30/40.2 |
| 2,643,452 | 6/1953 | Fennelly | 206/359 |
| 2,653,379 | 9/1953 | Austin | 30/40.2 |
| 2,663,079 | 12/1953 | Peterson | 30/40.2 |
| 2,679,685 | 6/1954 | Austin | 206/359 |
| 2,718,963 | 9/1955 | Austin | 30/40.2 |
| 2,741,837 | 4/1956 | Breazeale | 206/354 |
| 3,151,738 | 10/1964 | Stone | 206/360 |
| 3,587,170 | 6/1971 | Randol . | |
| 3,760,938 | 9/1973 | Ferrier, Jr. . | |
| 4,542,575 | 9/1985 | Revoyr . | |
| 5,604,984 | 2/1997 | Shepherd et al. | 30/125 |
| 5,727,320 | 3/1998 | Shepherd et al. | 30/125 |

*Primary Examiner*—Larry I. Schwartz
*Assistant Examiner*—John Preta
*Attorney, Agent, or Firm*—Charles W. Almer

[57] ABSTRACT

Blade replacement devices for shaving systems which have at least one blade removably connected to a blade support. The blade replacement devices of the present invention advantageously comprise means for receiving a used blade as it is removed from a razor.

11 Claims, 6 Drawing Sheets

BLADE REPLACEMENT DEVICE WITH USED BLADE STORAGE

The present invention is directed to blade replacement devices for shaving systems, such as injector blade systems and, more particularly, to a blade replacement device comprising a receptacle for receiving used blades as they are removed from a blade support.

BACKGROUND OF THE INVENTION

Shaving systems comprising replaceable blades and blade cartridges are known in the shaving industry. One type of shaving system which has been sold for many years is the injector blade system. One injector system comprises a razor having a guard surface, a cap normally biased downwardly against a rearward portion of the guard member and open sidewalls. A plurality of replacement blades are stored in a replacement blade compartment comprising an alignment stem and a slidable blade loader slidably positioned along the top of the replacement blade compartment. The replacement blades are biased upwardly in the replacement blade compartment toward the blade loader proximate one end of the compartment.

When a replacement blade is needed in the razor, the alignment stem of the replacement blade compartment is first inserted into a slot in the back of the razor in order to (1) properly align the replacement blades with the razor and (2) relieve some of the biasing pressure between the cap and the guard member. The blade loader is then slid from a position above the upwardly biased replacement blades away from the razor toward the other end of the replacement blade compartment in order to allow a replacement blade to move upwardly against the upper, inner surface of the replacement compartment. The blade loader is then advanced toward the razor and, since a new blade has moved upwardly, the blade loader engages the replacement blade thereby moving the replacement blade into position in the razor while simultaneously ejecting the used blade out the opposite end of the razor. The ejected blade falls freely from the razor.

While the injector system described above has enjoyed marketing success for many years, it suffers from several disadvantages. Often, the ejected used blade drops to the ground and requires the user to bend over to pick up the used blade. This can be uncomfortable, it takes time and may also lead to injuries due to the sharpness of the used blade. It would therefore be desirable to provide an improved blade replacement device which is easier to use, requires less time to complete a blade replacement, and which is safer to perform.

It would be particularly desirable to provide a blade replacement device which eliminates the need for a user to handle sharp blades during blade replacement.

SUMMARY OF THE INVENTION

The various embodiments of the present invention provide safe and efficient blade replacement devices for shaving systems which have at least one blade removably connected to a blade support. The blade replacement devices of the present invention advantageously comprise means for receiving a used blade as it is removed from a razor.

The illustrated preferred embodiments of the present invention, a blade replacement device comprises a used blade compartment for receiving used blades as they are ejected from a blade support and for subsequently storing used blades in a safe manner.

DETAILED DESCRIPTION

The various embodiments of the present invention are directed to improvements in blade replacement devices for shaving systems. Each illustrated embodiment of the present invention advantageously comprises a receptacle for receiving used blades as the used blades are removed from a blade support during the placement of one or more replacement blades.

Figure 2:
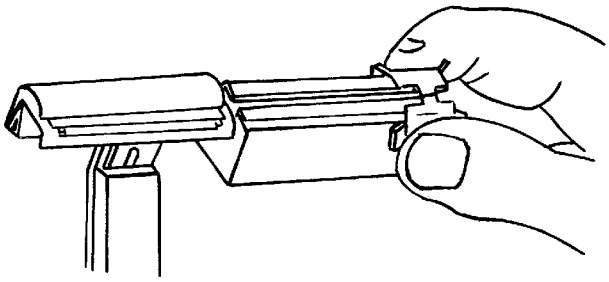
FIG. 2 (PRIOR ART)
FIGS. 2, 3 and 4 illustrate the use of the system shown in FIG. 1.
Figure 3:
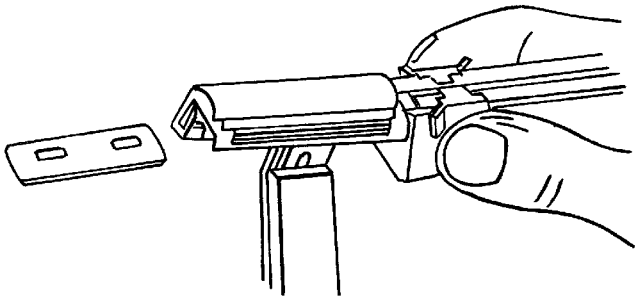
FIG. 3 (PRIOR ART)

The advantages of the present invention are readily appreciated when contrasted with a blade replacement device which has commonly been referred to as an "injector system" of the prior art. One such injector system of the prior art is illustrated in FIGS. 1 to 4. As shown in phantom in FIG. 1, the lower surface of the blade replacement device of this prior art system comprises a window through which used blades can be inserted into a lower compartment for storage. However, in order to get the blades into this lower compartment, an ejected used blade which has fallen freely from the razor after being ejected during the placement of a new blade as shown in FIGS. 2 and 3, requires handling by the user. The various embodiments of the present invention advantageously eliminate the need for a person to handle a used blade which, though dull from shaving, is still capable of inflicting a cut.

Figure 1:
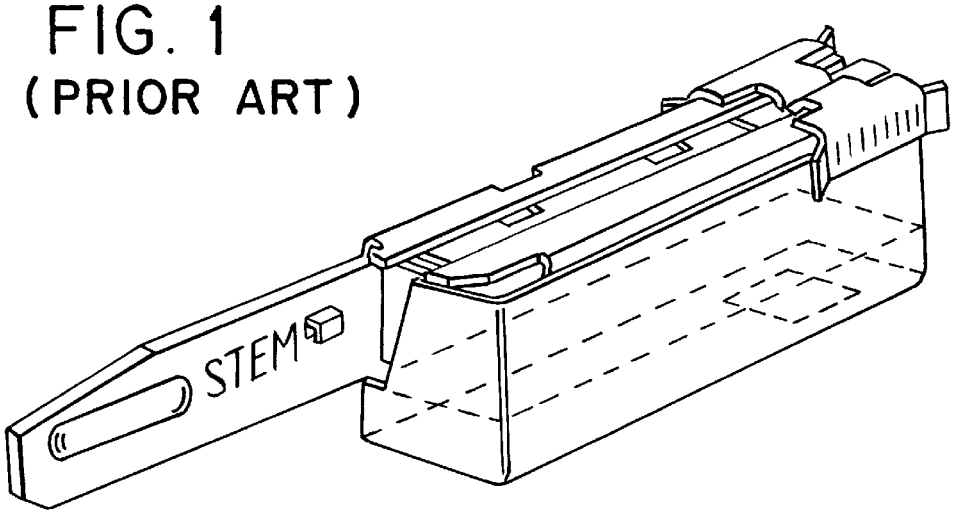
FIG. 1 (PRIOR ART)
FIG. 1 is a perspective view of a prior art injector system.
Figure 7:
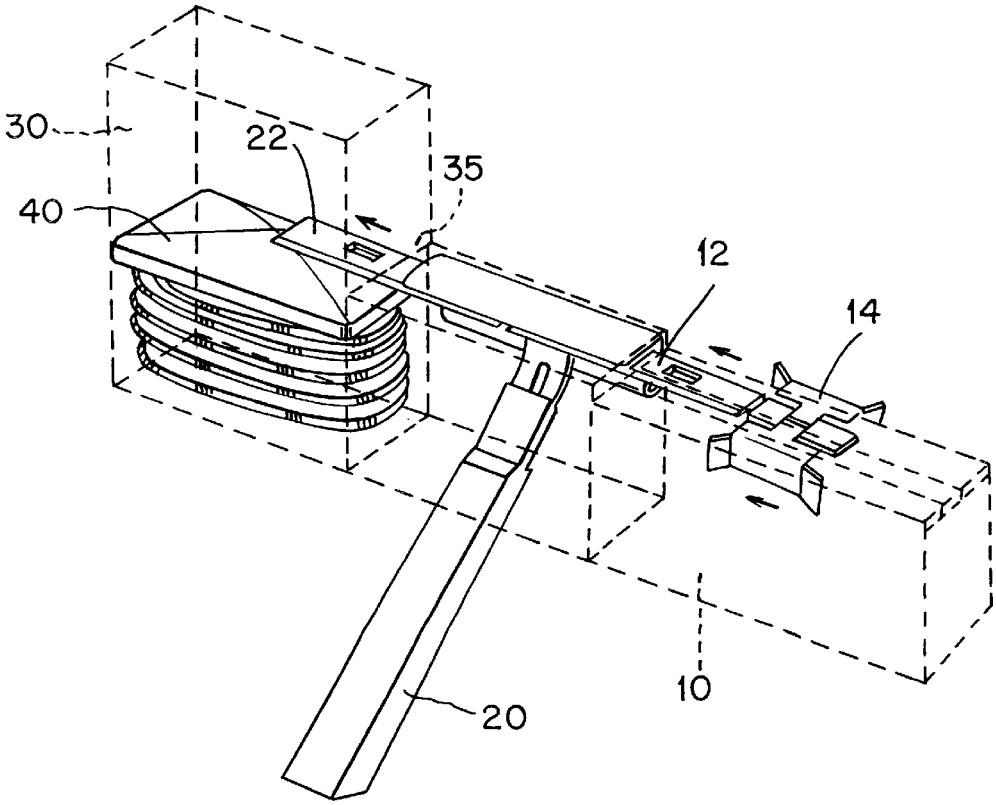
FIG. 7 is a top perspective view of the blade replacement device shown in FIG. 6 with portions shown in phantom.
Figure 4:
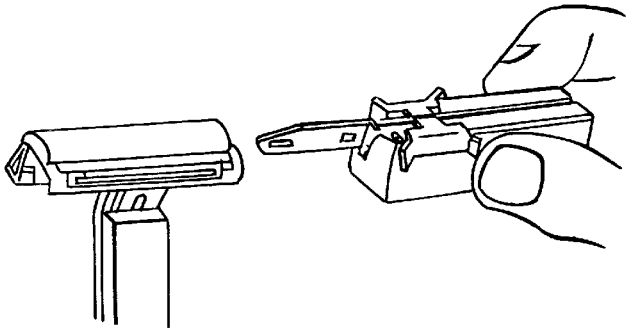
FIG. 4 (PRIOR ART)
Figure 5:
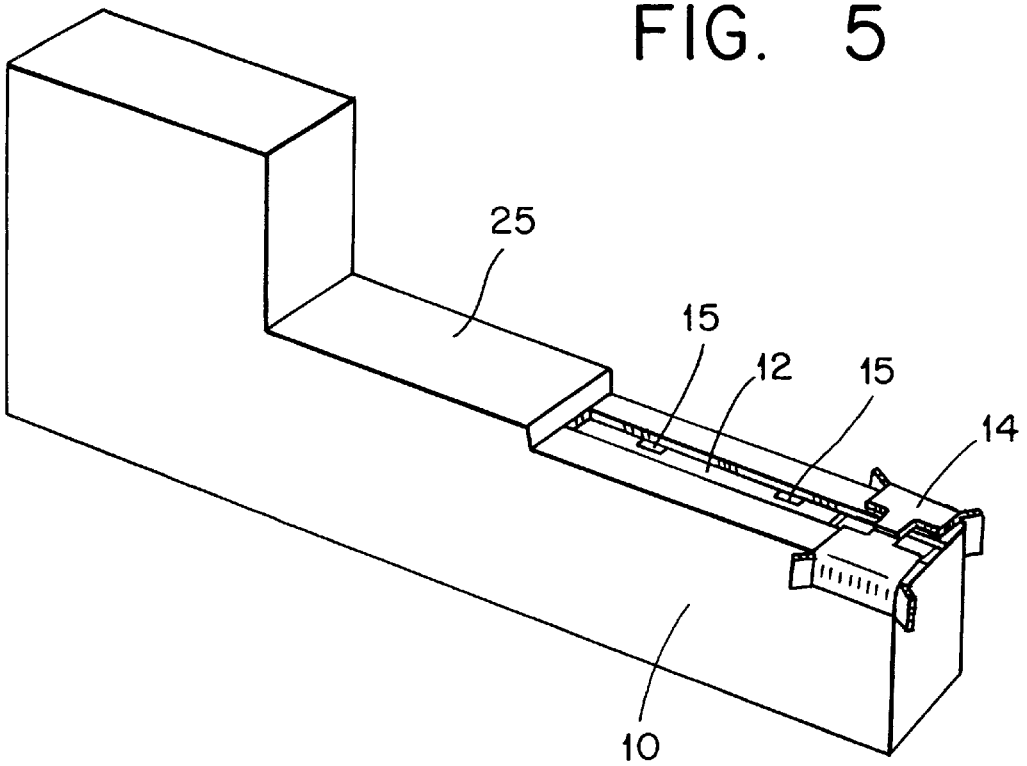
FIG. 5 is a top perspective view of one embodiment of the present invention.
Figure 6:
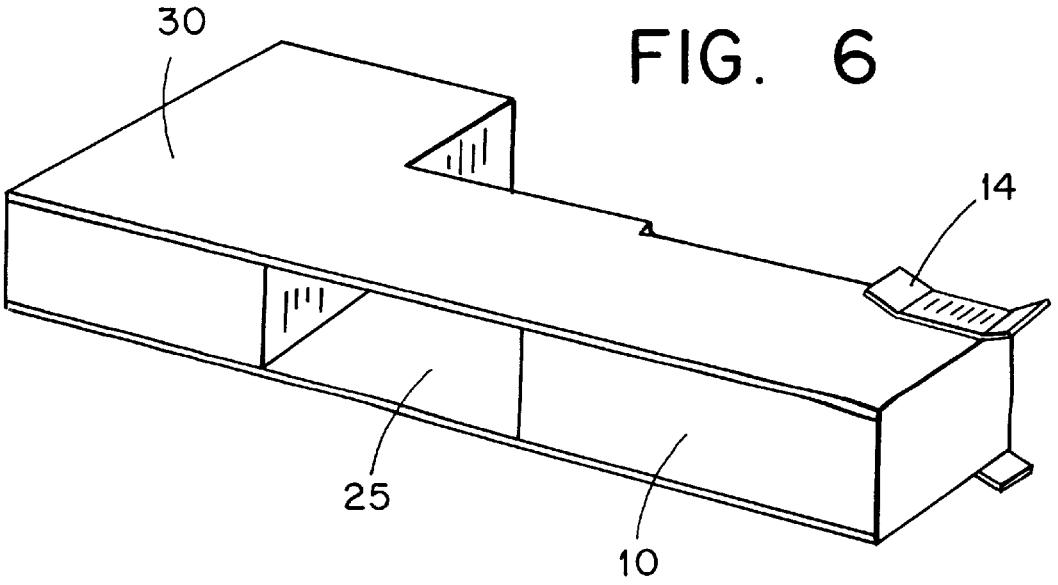
FIG. 6 is a bottom perspective view of the blade replacement device of the present invention shown in FIG. 5.
Figure 9:
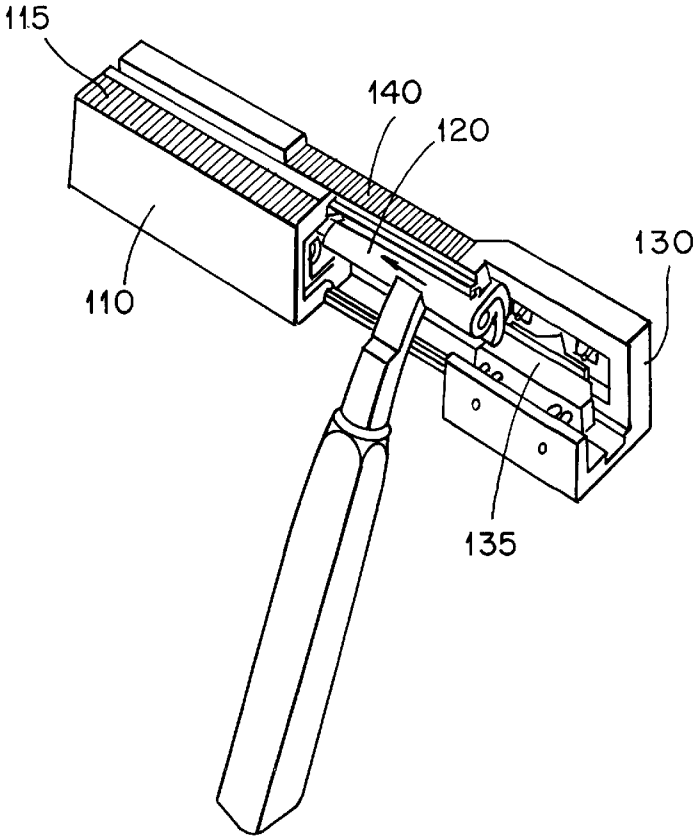
FIGS. 8–11 are top perspective view of another embodiment of the present invention illustrating the positioning of a replacement blade and simultaneous ejection of an old blade.
Figure 8:
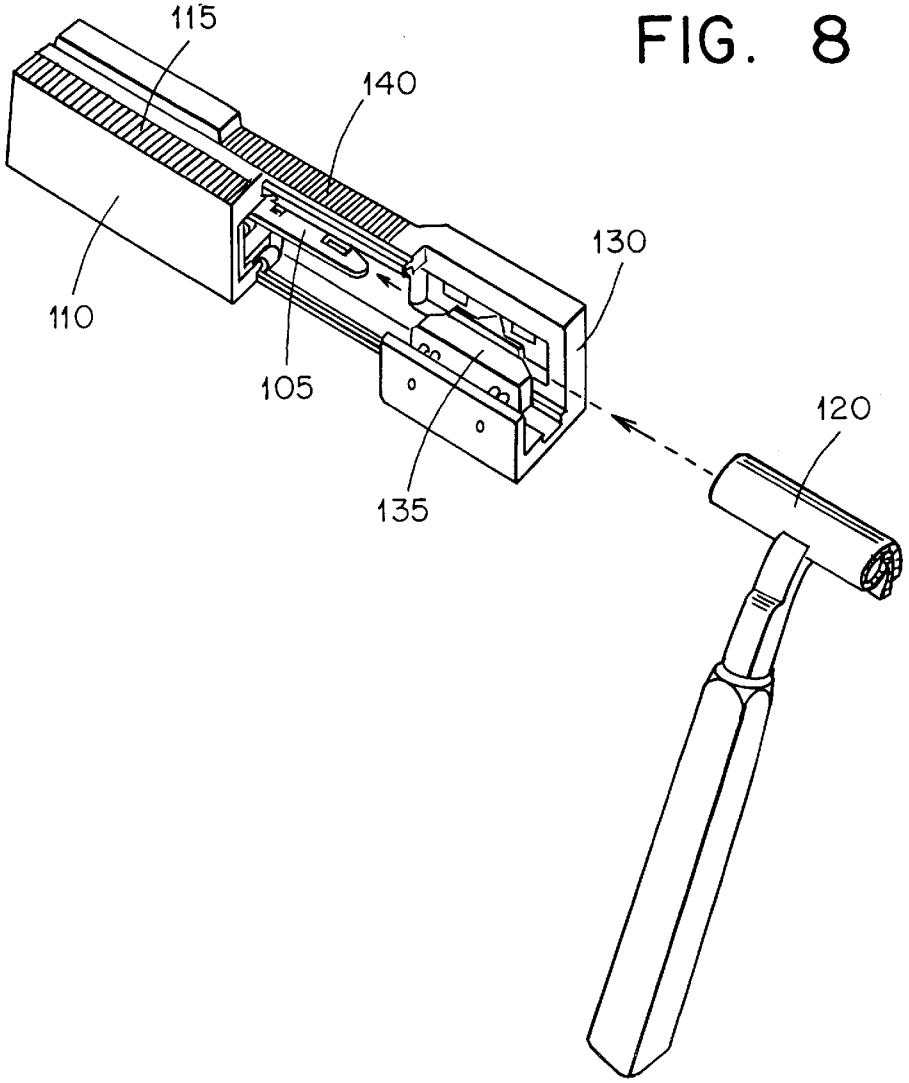

One embodiment of the present invention, illustrated in FIGS. 5 to 7 is particularly adapted for use with the prior art razor illustrated in FIGS. 2 to 4. This illustrated embodiment advantageously comprises a replacement blade compartment 10 for storing replacement blades 12 and a slidable blade loader 14. This portion of the illustrated blade replacement device operates in the same manner as described above with respect to the prior art.

Prior to loading a replacement blade in a razor, a razor is inserted into a razor 20 compartment 25 in the manner illustrated in FIG. 7. In order to advance a replacement blade 12 into the razor 20, the blade loader 14 on the replacement blade compartment 10 is first slid in the direction away from the razor compartment 25 in order to allow a replacement blade 12 to move all the way upwardly in replacement blade compartment 10. The blade loader 14 is then slid toward razor 20, thereby driving replacement blade 12 into position in razor 20 and simultaneously moving used blade 22 out of razor 20 and into used blade receptacle 30. The replacement blade 12 may be utilized to push the used blade 22 into the used blade receptacle 30.

The razor positioning compartment 25 advantageously comprises a forward wall, a rearward wall, a top wall and a bottom opening through which razor 20 may be inserted. Since the upper and rearward surfaces of the razor lie in planes which meet at about 90 degrees, the razor is readily positioned in alignment to receive a replacement blade 12 by simply positioning the upper portion of razor 20 at the top of razor compartment 25. From the present description, those skilled in the art will appreciate that the upper, inner surface of razor compartment 25 will extend above the plane through which blades travel during replacement/ejection in order to provide room for the forward portion of razor 20. It will also be appreciated that even more accurate alignment of the razor with respect to the blade replacement device may be achieved by forming the upper portion of razor compartment 25 as an exact complement to the outer surface of the razor 20. Such shaping of the razor compartment 25 is well within the skill of those skilled in the art in light of the present description and, therefore, is not described further herein.

Used blades storage compartment 30 advantageously comprises a slot 35 in order to receive a used blade 22. In this manner, a used blade 22 is moved directly into used blade storage compartment 30 when a new blade 12 is moved into razor 20 by blade loader 14.

Used blade storage compartment 30 may also comprise means for retaining a used blade within the compartment in order to avoid accidental ejection of a used blade from the blade replacement device when the device is not in use. To this end, the illustrated embodiment can be provided with a pair of guides dimensioned and positioned to pass through positioning holes 15 (best shown in FIG. 5) of a used blade 22 after the used blade 22 has been positioned within used blade storage compartment 30. Additionally, a biasing member 40 can advantageously be provided in order to urge used blades on to the guide members.

Furthermore, since the opening to razor compartment 25 is at the bottom of that compartment in this illustrated embodiment, during use, a user may readily invert the blade replacement device and insert the razor downwardly. This positioning of the device will allow gravity to assist in the positioning of a used blade 22 onto blade guides.

Figure 11:
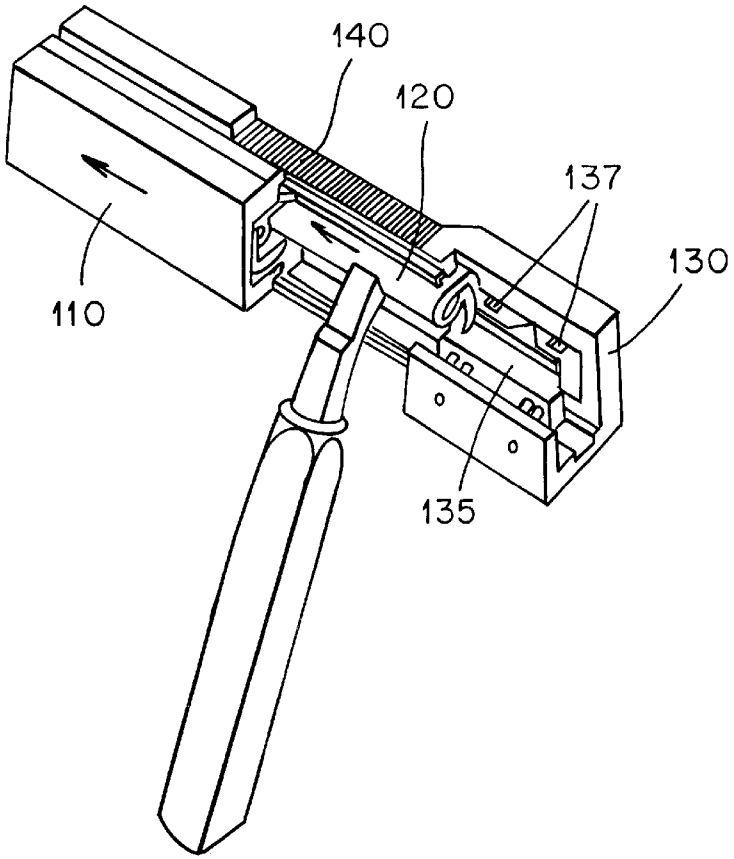
Figure 12:
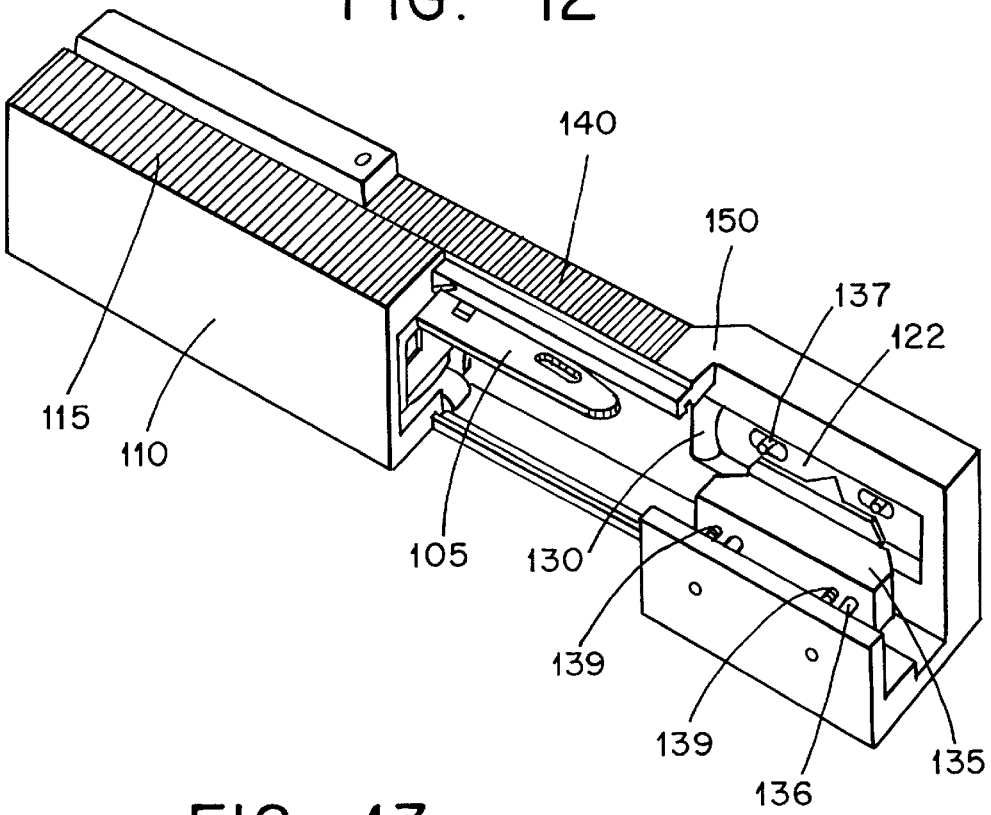
FIG. 12 is an enlarged perspective view of the blade replacement device illustrated in FIGS. 8–11.
Figure 13:
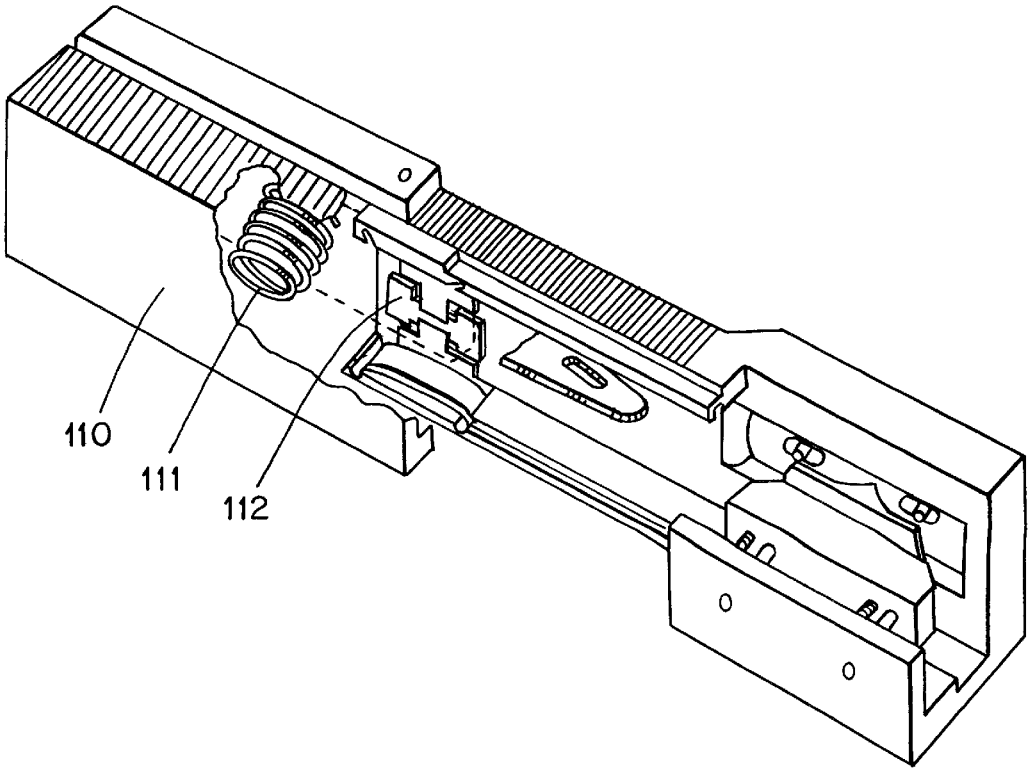
FIG. 13 is the same view as FIG. 12 with sections removed.

According to a preferred embodiment of the present invention illustrated in FIGS. 8–13, a more compact blade replacement device is provided. This illustrated embodiment comprises a replacement blade compartment 110, a guide stem 105, and a used blade receptacle 130 mounted on a frame which is slidably connected to the replacement blade compartment 110. As best shown in FIGS. 12–13, a biasing member 135 is positioned opposite the used blade storage compartment 130. The biasing member 135 is slidably mounted on pins 136 and biased by springs 139 into contact with used blades 122 supported on guide pins 137. For reasons which will be described below, the body portion of biasing member 135 gradually tapers to a point which preferably contacts the outer most used blade 122 in order to maintain all used blades within used blade storage compartment 130.

In order to facilitate moving the replacement blade compartment 110 relative to the used blade storage support frame 150, the support frame 150 comprises a gripping area 140 and the sides of the new blade compartment 110 comprise gripping areas 115 which are designed to provide a non-slip grip surface. Those skilled in the art will appreciate that these non-slip areas can be roughened or coated with any desirable material which will allow a user to grip these relatively movable portions of the blade replacement device during the replacement/ejection process.

Figure 10:
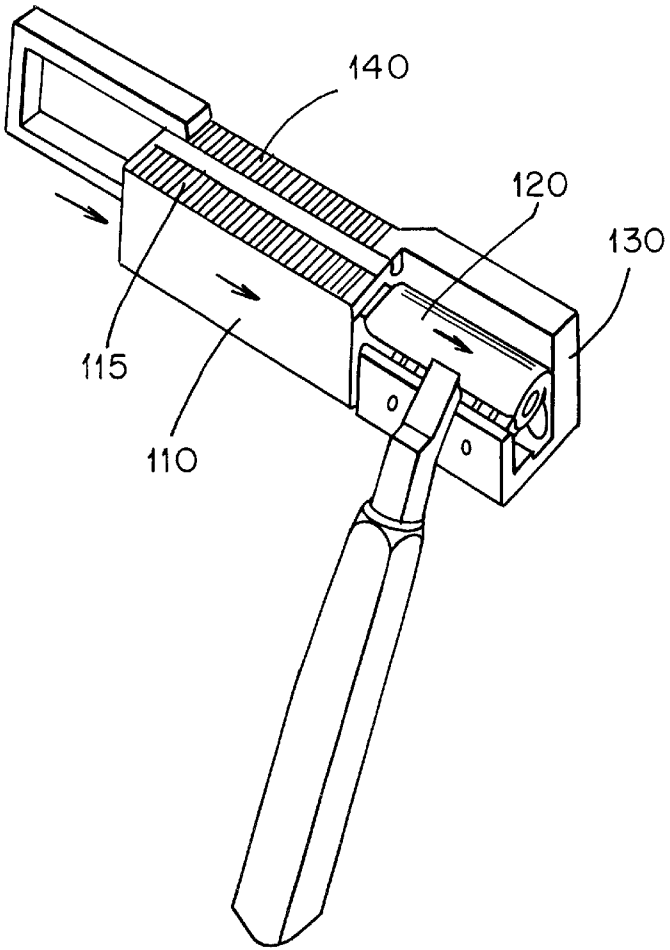

As best illustrated in FIGS. 8–11, a razor 120 is slid between biasing member 135 and used blade storage compartment 130. The tapered surfaces of the biasing member 135 facilitate the retraction of the biasing member 135 away from the used blades storage compartment 130 in response to a razor which is slid between these two elements toward the guide stem 105. The upper portion of the razor 120 slides onto guide stem 105 according to this illustrated embodiment. The guide stem 105 engages razor 120 in a manner similar to that shown with the prior art injector illustrated in FIGS. 1–4. With the razor 120 securely positioned on guide stem 105, roughened side portion 115 of the new blade compartment 110 is grasped in one hand while the roughened portion 140 of the used blade frame is grasped in the other hand and the new blade compartment 110 is slid toward biasing member 135. When replacement blade compartment 110 is moved to the position shown in FIG. 10, a replacement blade is permitted to slide into the loading position and into alignment with the blade position in razor 120. From the cut-away view of FIG. 13, it can be appreciated that new blade storage compartment 110 comprises a spring 111 which normally biases new blades into contact with blades stop 112 mounted on the interior face of frame 150. Since the blade stop 112 is normally aligned with the new blades in the new blade storage compartment 110, the blades do not advance past the lateral face of the blade stop 112. However, when the new blade storage compartment 110 is slid toward biasing member 135 as illustrated in FIG. 10, a single new blade will be advanced to a loading position by spring 111. The forward edge 113 of blade stop 112 is positioned immediately to the left of the replacement blade when the replacement blade is in the loading position and thereby prevents the replacement blade from being retracted with replacement blade compartment 110 when the replacement blade compartment 110 is slid back into the position shown in FIG. 11. Thus, when razor, 120 and replacement blade compartment 110 are slid away from biasing member 135 as illustrated in FIG. 11, the new replacement blade is guided into the razor 120 thereby ejecting the used blade into the used blade storage compartment.

As stated above, two guide pins 137 are provided in used blade storage compartment 130. These pins 137 pass through holes in a used blade and biasing member 135 advantageously maintains the used blade on guide pins 137.

From the present description, those skilled in the art will appreciate that the various embodiments of the present invention advantageously provide a safer, quicker and more efficient blade replacement device for use with shaving systems having at least one blade removably connected to a blade support.

What is claimed is:

1. A blade replacement device for a shaving system, said shaving system comprises at least one first blade, having a cutting edge, removably connected to a blade support, said blade replacement device comprising:

selectively movable means for removing said first blade from said blade support, means for receiving said first blade as said first blade is removed from said blade support by said selectively movable means for removing said first blade from said blade support, and a movable compartment for providing a replacement blade for replacing said first blade on said blade support, wherein said movable compartment is movable in relation to said means for receiving said first blade.

2. A blade replacement device according to claim 1 wherein said receiving means substantially covers said cutting edge of said first blade.

3. A blade replacement device according to claim 1 wherein said receiving means comprises a substantially enclosed compartment for receiving said first blade.

4. A blade replacement device according to claim 1 wherein said selectively movable means for removing said first blade from said blade support comprises: means for engaging a replacement blade and aligning said replacement blade with said blade support.

5. A blade replacement device according to claim 4 wherein at least one of said selectively movable means for removing said first blade from said blade support or said replacement blade engage said first blade for moving said first blade to said receiving means.

6. A blade replacement device according to claim 1 further comprises a plurality of replacement blades.

7. A blade replacement device according to claim 6 wherein said replacement blades are biased toward a replacement position in said blade replacement device.

8. A blade replacement device according to claim 7 wherein said blade replacement device comprises means for aligning a plurality of blades.

9. A blade replacement device according to claim 8 wherein said aligning means comprises at least one biasing member.

10. A blade replacement device according to claim 1 wherein said blade replacement device comprises means for aligning a plurality of blades.

11. A blade replacement device according to claim 10 wherein said aligning means comprises at least one biasing member.

* * * * *